US006457970B1

(12) United States Patent
Park

(10) Patent No.: US 6,457,970 B1
(45) Date of Patent: Oct. 1, 2002

(54) COMBUSTION DEVICE OF GAS BURNER FOR COOKING

(76) Inventor: Myung-Sun Park, Gapo 1st Woosung Apt. 2-1101, 503, Daechi-dong, Kangnam-Ku, Seoul (KR)

( * ) Notice: Subject to any disclaimer, the term of this patent is extended or adjusted under 35 U.S.C. 154(b) by 116 days.

(21) Appl. No.: 10/030,360

(22) PCT Filed: Apr. 14, 2001

(86) PCT No.: PCT/KR01/00621

§ 371 (c)(1),
(2), (4) Date: Jan. 2, 2001

(87) PCT Pub. No.: WO01/88437

PCT Pub. Date: Nov. 22, 2001

(30) Foreign Application Priority Data

May 3, 2000 (KR) ..... 00/12662 U

(51) Int. Cl.[7] ..... F23D 14/70

(52) U.S. Cl. ..... 431/347; 431/348; 126/39 R; 126/214 D

(58) Field of Search ..... 431/171, 347, 431/348, 354; 126/39 R, 39 E, 92 R, 92 AC, 92 C, 214 D

(56) References Cited

U.S. PATENT DOCUMENTS 1,120,219 A * 12/1914 Mudge ..... 126/92 R
1,808,319 A * 6/1931 Roberts ..... 126/92 C
1,810,373 A * 6/1931 Roberts ..... 126/92 C
1,818,783 A * 8/1931 Beam ..... 431/354
1,862,892 A * 6/1932 Haskell ..... 126/92 C
1,880,719 A * 10/1932 Blakesley ..... 126/92 C
1,886,866 A * 11/1932 Blakesley ..... 126/92 C
1,931,589 A * 10/1933 Roberts ..... 431/347
1,997,036 A * 4/1935 Atwater ..... 431/347
2,044,511 A * 6/1936 Ryschkewitsch ..... 126/92 R
2,384,022 A * 9/1945 Fuller ..... 431/348
3,687,602 A * 8/1972 Vignes ..... 431/347
4,264,298 A * 4/1981 Gimeoni ..... 431/347

FOREIGN PATENT DOCUMENTS

GB 2228565 A * 8/1990
JP 2001-193934 A * 7/2001

* cited by examiner

*Primary Examiner*—Sara Clarke
(74) *Attorney, Agent, or Firm*—F. Chau & Associates, LLP

(57) ABSTRACT

The object of this invention is to provide a combustion device for cooking gas burners. In the combustion device, a frusto-conical flame guide cover (30) having an inclined side surface (31) is seated at the center of the inside area (11) of an annular-shaped bumer head (10). In such a case, the nozzle tips (20) are inclinedly arranged on the bumer head (10) such that the axes of the mixed gas outlets (24) of the tips (20) are converged at a predetermined height of the central axis (32) of the flame guide cover (30). The combustion device of this invention effectively uses low pressure and low price gases such as LNG and quickly generates high temperature heat expected from the conventional middle pressure or high pressure gas burners.

2 Claims, 3 Drawing Sheets

COMBUSTION DEVICE OF GAS BURNER FOR COOKING

TECHNICAL FIELD

The present invention relates, in general, to a combustion device for cooking gas burners and, more particularly, to a combustion device for cooking gas burners, required to quickly generate very high temperature heat and typically used in some restaurants, particularly, Chinese restaurants.

BACKGROUND ART

Some restaurants, particularly, Chinese restaurants typically use high temperature cooking gas burners designed to quickly generate very high temperature heat. In the prior art, middle pressure gas burners or high pressure gas burners have been typically used in such restaurants. Of the conventional cooking gas burners, flame collision type gas burners, designed to bring flames from two nozzle tips into a collision with each other and attenuate the lifting action of the flames and thereby stabilize the flame, have been most typically used in such restaurants. However, such flame collision type gas burners are problematic in that it is necessary for the gas burners to quickly eject a great amount of gas from the nozzle tips, and so the burners do not use low pressure and low price gases such as LNG, but they must use high pressure and high price gases such as LPG.

DISCLOSURE OF THE INVENTION

Accordingly, the present invention has been made keeping in mind the above problems occurring in the prior art, and an object of the present invention is to provide a combustion device for cooking gas burners, which effectively uses low pressure and low price gases such as LNG and quickly generates high temperature heat expected from the conventional middle pressure or high pressure gas burners.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
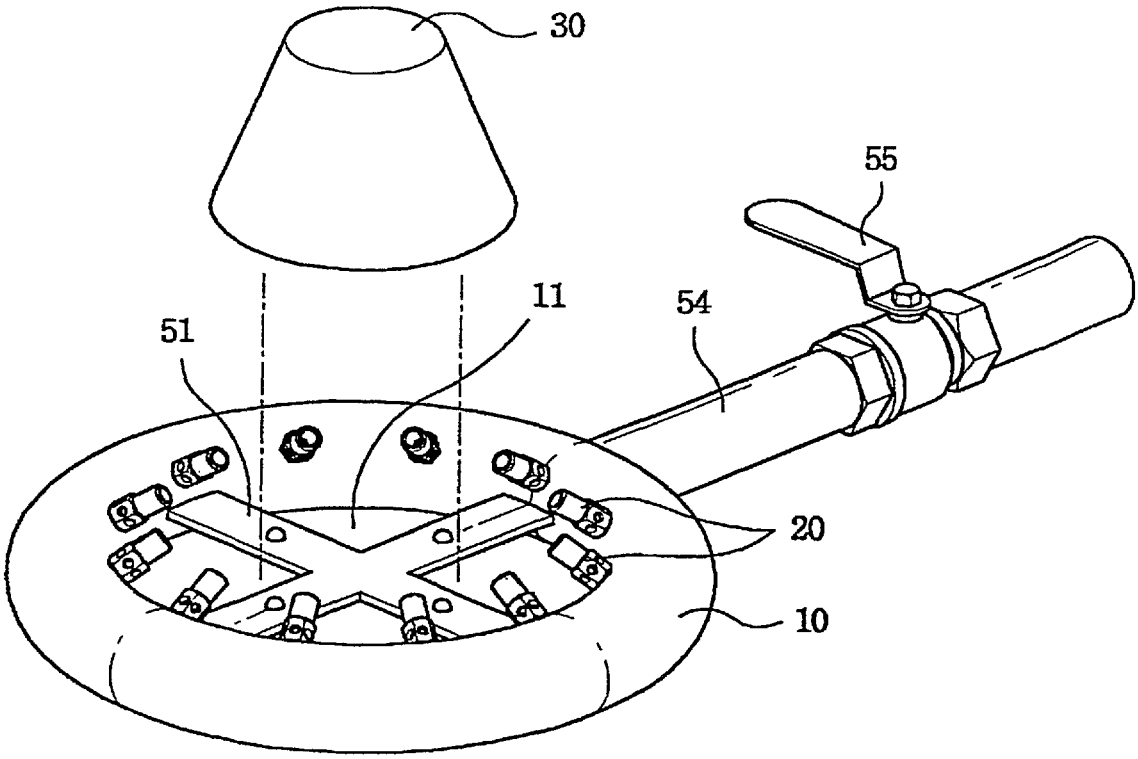
FIG. 1 is an exploded perspective view of a combustion device for cooking gas burners in accordance with the preferred embodiment of the present invention.

Reference now should be made to the drawings, in which the same reference numerals are used throughout the different drawings to designate the same or similar components.

Figure 2:
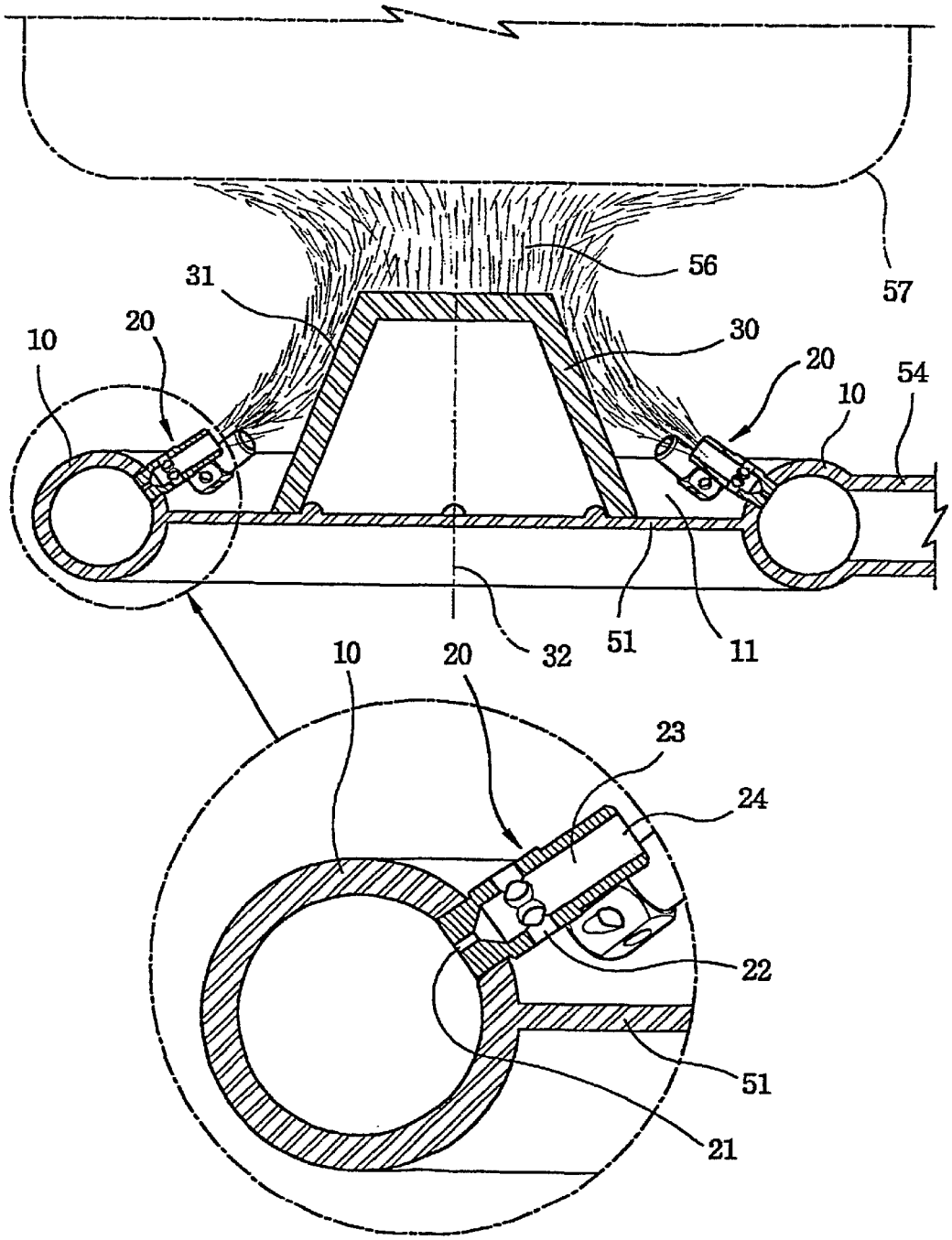
FIG. 2 is a sectional view, showing an operation of the combustion device of this invention.
Figure 3:
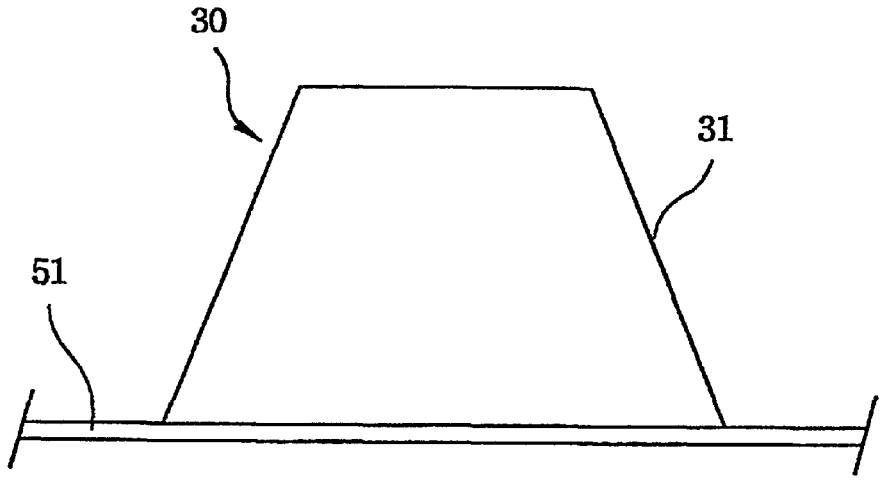
FIGS. 3 and 4 are front views of flame guide covers of the combustion device according to different embodiments of this invention.
Figure 4:
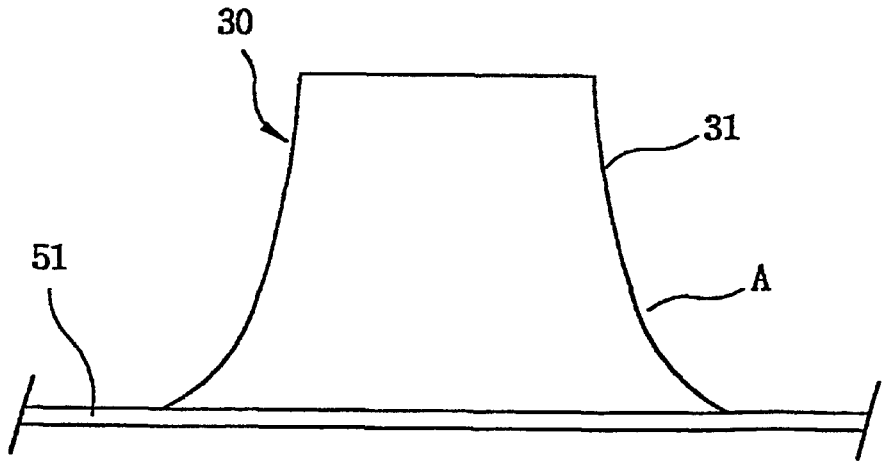

As shown in the drawings, the combustion device for cooking gas burners in accordance with the preferred embodiment of the present invention comprises an annular-shaped burner head 10, and a plurality of nozzle tips 20 regularly arranged along the annular top surface of the burner head 10. Each of the nozzle tips 20 consists of a tubular body, which defines a gas mixing passage 23 therein and includes a gas nozzle 21 at its inside end, a first combustion air feed hole 22 at its sidewall, and a mixed gas outlet 24 at its outside end. The gas mixing passage 23 extends from the gas nozzle 21 to the mixed gas outlet 24, and has a diameter larger than that of the nozzle 21. The above-mentioned construction of the combustion device remains the same as that of a conventional combustion device for cooking gas burners. in accordance with the present invention, a frusto-conical flame guide cover 30 having an inclined side surface 31 is seated at the center of an inside area 11 of the annular-shaped burner head 10. In addition, the nozzle tips 20 are inclinedly installed on the burner head 10 such that the axes of the mixed gas outlets 24 are converged at a predetermined height of the central axis 32 of the flame guide cover 30. In the present invention, the inclined sidewall of the flame guide cover 30 may be designed to have a flat side surface 31 as shown in FIGS. 1, 2 and 3. Alternatively, the sidewall of the flame guide cover 30 may be inwardly curved to form a curved side surface 'A' as shown in FIG. 4 without affecting the functioning of this invention. In the drawings, the reference numeral 51 denotes a support rib used for supporting the flame guide cover 30 in the inside area 11 of the burner head 10, the numeral 54 denotes a gas feed pipe, the numeral 55 denotes a gas control valve mounted to the gas feed pipe 54, the numeral 56 denotes a flame, and the numeral 57 denotes a cooking pot laid on the combustion device of this invention.

In order to use the combustion device of this invention for cooking, the gas feed pipe 54 is connected to a low pressure gas supply source (not shown), such as an LNG supply source, prior to opening the pipe 54 by controlling the valve 55. When the gas control valve 55 is opened, low pressure gas is fed from the gas supply source to the nozzle tips 20 through the gas feed pipe 54 and the burner head 10. In the nozzle tips 20, the gas. is injected into the gas mixing passage 23, and is mixed with first combustion air flowing into the passage 23 through the air feed hole 22, thus producing mixed gas. The mixed gas is, thereafter, ejected from the nozzle tips 20 toward the sidewall of the flame guide cover 30 through the mixed gas outlet 24, and is secondarily mixed with second combustion air at the outside of the tips 20.

When the mixed gas ejected from the nozzle tips 20 is ignited by a conventional ignition means, the gas is burnt to produce flames 56. In such a case, the tips 20 are inclinedly installed along the top surface of the. burner head 10 such that the mixed gas outlets 24 of the tips 20 are directed toward the flame guide cover 30 so as to make their axes converge at the same height of the central axis 32 of the cover 30. Therefore, the flames 56 from the outlets 24 inclinedly and upwardly collide on the inclined surface 31 of the flame guide cover 30. The lifting action of the flames 56 is attenuated, and so the flames 56 are stabilized. In addition, desired complete combustion of the flames 56 is accomplished.

The flames 56 move upward along the inclined side surface 31 of the flame guide cover 30 so as to be concentrated at the top of the cover 30. That is, the mixed gas from the outlets 24 of the nozzle tips 20 installed on the burner head 10 is completely burnt to form the flames 56, and the flames 56 are concentrated at the top of the flame guide cover 30 to be confined to an area defined by the top edge of the cover 30 or into a smaller area. Therefore, the intensity of the flames 56 is desirably increased. When the sidewall of the flame guide cover 30 is designed to have an inwardly curved side surface 'A', it is possible to make a smooth flow of flames 56 along the side surface of the cover 30. The flame guide cover 30 having the. curved side surface 'A' is also advantageous in that it is easier to control the flow of flames 56 along the side surface of the cover 30.

INDUSTRIAL APPLICABILITY

As described above, the present invention provides a combustion device for cooking gas burners. The combustion device of this invention is designed such that the mixed gas from the outlets 24 of the nozzle tips arranged on the burner head is completely burnt to form flames 56, and the flames 56 move upward along the inclined side surface 31 of the flame guide cover 30 while being guided by the surface 31, thus being concentrated at the top of the cover 30 into a desired small area. The intensity of flames 56 is thus desirably increased. The combustion device of this invention thus effectively generates very high temperature heat using low pressure gas such as LNG. A cooking gas burner using the combustion device of this invention is preferably used in some restaurants, particularly, Chinese restaurants.

What is claimed is:

1. A combustion device of a gas burner for cooking, comprising an annular-shaped burner head (10), and a plurality of nozzle tips (20) arranged along an annular top surface of said burner head (10), each of said nozzle tips (20) defining a gas mixing passage (23) therein and including a gas nozzle (21), a first combustion air feed hole (22), and a mixed gas outlet (24), further comprising:

a frusto-conical flame guide cover (30) having an inclined side surface (31) and seated at the center of an inside area (11) of the annular-shaped burner head (10), whereby said nozzle tips (20) are inclinedly arranged on the burner head (10) such that the axes of the mixed gas outlets (24) are converged at a predetermined height of a central axis (32) of the flame guide cover (30).

2. The combustion device according to claim 1, wherein the inclined side surface (31) of the flame guide cover (30) is an inwardly curved side surface (A).

* * * * *